US011145972B2

(12) United States Patent
Yang

(10) Patent No.: US 11,145,972 B2
(45) Date of Patent: Oct. 12, 2021

(54) ANTENNA OSCILLATOR AND ANTENNA

(71) Applicant: SHENZHEN ANTOP TECHNOLOGY CO., LTD., Shenzhen (CN)

(72) Inventor: Ruidian Yang, Shenzhen (CN)

(73) Assignee: Shenzhen Antop Technology Co., Ltd., Shenzhen (CN)

( * ) Notice: Subject to any disclaimer, the term of this patent is extended or adjusted under 35 U.S.C. 154(b) by 111 days.

(21) Appl. No.: 16/679,103

(22) Filed: Nov. 8, 2019

(65) Prior Publication Data

US 2021/0098871 A1 Apr. 1, 2021

(30) Foreign Application Priority Data

Sep. 30, 2019 (CN) ..... 201921673261.4

(51) Int. Cl.
*H01Q 1/36* (2006.01)
*H01Q 3/06* (2006.01)
*H01Q 13/10* (2006.01)

(52) U.S. Cl.
CPC ..... *H01Q 3/06* (2013.01); *H01Q 1/36* (2013.01); *H01Q 13/106* (2013.01)

(58) Field of Classification Search
CPC ..... H01Q 3/06; H01Q 1/36; H01Q 13/10; H01Q 13/103; H01Q 13/106
See application file for complete search history.

(56) References Cited

U.S. PATENT DOCUMENTS

2003/0201944 A1* 10/2003 Aikawa ..... H01Q 13/10 343/770

* cited by examiner

*Primary Examiner* — Seokjin Kim
(74) *Attorney, Agent, or Firm* — Robert L. Stearns; Dickinson Wright, PLLC

(57) ABSTRACT

The disclosure applies to the field of antenna technology, which provides an antenna oscillator and an antenna. The antenna oscillator includes an antenna oscillator body, the antenna oscillator body has a rectangular planar plate-like structure. The first slit and the second slit have strip-shaped structures without branches and are configured on the antenna oscillator body. The first slit and the second slit extend in the direction of the long side of the rectangle and the antenna oscillator body is configured with a pore structure. It can receive and transmit electromagnetic wave signals of a larger bandwidth, expand the effective bandwidth of the antenna oscillator and obtain better signal intensity for each frequency within the effective bandwidth.

13 Claims, 10 Drawing Sheets

ANTENNA OSCILLATOR AND ANTENNA

CROSS REFERENCE TO RELATED APPLICATION

This application claims priority to Chinese Patent Application No. CN201921673261.4 filed on filed on Sep. 30, 2019, the entire disclosure of which is incorporated herein by reference in its entirety.

TECHNICAL FIELD

The disclosure relates to the field of antenna technology, in particular, to an antenna oscillator and an antenna.

BACKGROUND

An antenna formed by slitting on a conductor surface is called a slit antenna, also called a slot antenna. A typical shape of a slit is a long strip having a length of about half a wavelength, and the slit may be fed by a transmission line across its narrow side and may also be fed by a waveguide or a resonant cavity, in this case, a radio frequency electromagnetic field is excited on the slit and electromagnetic waves are radiated to the space.

The popularity of a digital TV has an increasing demand for the antenna design of a wireless band of the digital TV. To supplement a charging cable TV mode, an antenna for the digital TV is needed to match the TV and watch the TV for free. A band of signals of the digital TV is very wide, however, an effective bandwidth of a current antenna oscillator is too narrow to meet the growing demand of the digital television.

SUMMARY

A purpose of the disclosure is to provide an antenna oscillator, which aims to solve the technical problem that the effective bandwidth of the conventional antenna oscillator is too narrow.

The present disclosure is realized in a way of an antenna oscillator, which includes an antenna oscillator body. The antenna oscillator body has a planar sheet structure in a form of a rectangle and is provided with a first slit and a second slit, the first slit and the second slit have a long strip-shaped structure without a branch, and the first slit and the second slit extend in a direction of a long side of the rectangle, and the antenna oscillator body is provided with a pore structure.

In one embodiment of the present disclosure, the first slit and the second slit are equal in width, parallel to each other, and equal in length, and are located at a middle position of the rectangle. The pore structures are configured at two sides of the middle position in a longitudinal direction of the first slit and two sides of the middle position in a longitudinal direction of the second slit; the first slit and the second slit are symmetrical about a perpendicular bisector of a short side of the rectangle and/or the long side of the rectangle.

In one embodiment of the present disclosure, the antenna oscillator further includes a connecting component, the connecting component is connected to an edge position of the antenna oscillator body, and there is an angle between the connecting component and a plane in which the antenna oscillator is located.

In one embodiment of the present disclosure, the antenna oscillator body and the connecting component are made of one piece by a metal material.

In one embodiment of the present disclosure, the antenna oscillator body is further provided with a third slit, and the third slit is arranged between the first slit and the second slit.

In one embodiment of the present disclosure, the antenna oscillator body is further provided with a fourth slit and a fifth slit, and the fourth slit and the fifth slit have a length smaller than the first slit and are arranged at a side of the first slit facing away from the third slit and a side of the second slit facing away from the third slit, respectively.

Another purpose of the present disclosure is to provide an antenna including the antenna oscillator as described above. The antenna further comprises a radiation component and a reflection component, the radiation component is arranged at a side of the antenna oscillator and is configured for feed connection with the antenna oscillator, a position of the radiation component corresponds to a middle position of the first slit and the second slit in a longitudinal direction, and the reflection component is arranged at a side of the radiation component facing away from the antenna oscillator and is insulated from the antenna oscillator.

In one embodiment of the present disclosure, the radiation component is provided with a first through hole opposite to a position of the pore structure, and the first through hole is configured to mount and fix the radiation component.

In one embodiment of the present disclosure, the radiation component is arranged at a side of the antenna oscillator and at a position corresponding to a portion between the first slit and the second slit, the radiation component includes a first extended portion and a second extended portion, the first extended portion is configured for feed connection with the antenna oscillator body, and an edge of the second extended portion is aligned with inner edges of the first slit and the second slit.

In one embodiment of the present disclosure, the reflection component is configured with a second through hole for arranging a PCB expansion board.

The antenna oscillator provided by the present disclosure has at least the following beneficial effects.

The antenna oscillator provided by the present disclosure is based on a signal principle of the slit antenna and the symmetric oscillator, which transmits signals in a form of coupled radiation. The antenna oscillator body is configured with the parallel first slit and second slit which have the same long stripe-shaped structure without a branch. Compared with the traditional slit antenna, it can receive and transmit electromagnetic wave signals with a larger bandwidth, expand the effective bandwidth of the antenna oscillator, and obtain better signal intensity for each frequency in the effective bandwidth, thereby being more stable to receive and transmit signals of various frequencies within the effective bandwidth. Due to the expansion of the effective bandwidth, during a production process of the antenna oscillator provided by the present disclosure, the time cost brought by matching, installation and test for impedance of a matching circuit can be effectively reduced, and the cost of materials such as an inductor board and a capacitor board can be reduced, and even there is no requirement for an external matching circuit, thereby directly reducing the steps in a production line and greatly reducing the cost of antenna products.

BRIEF DESCRIPTION OF THE DRAWINGS

In order to illustrate the technical solutions in the embodiments of the present disclosure more clearly, the drawings used in the embodiments will be briefly described below. It is obvious that the drawings in the following description are only some embodiments of the present disclosure. To an ordinary person in this art, other drawings may also be obtained based on these drawings before they devote inventive work.

Figure 1:
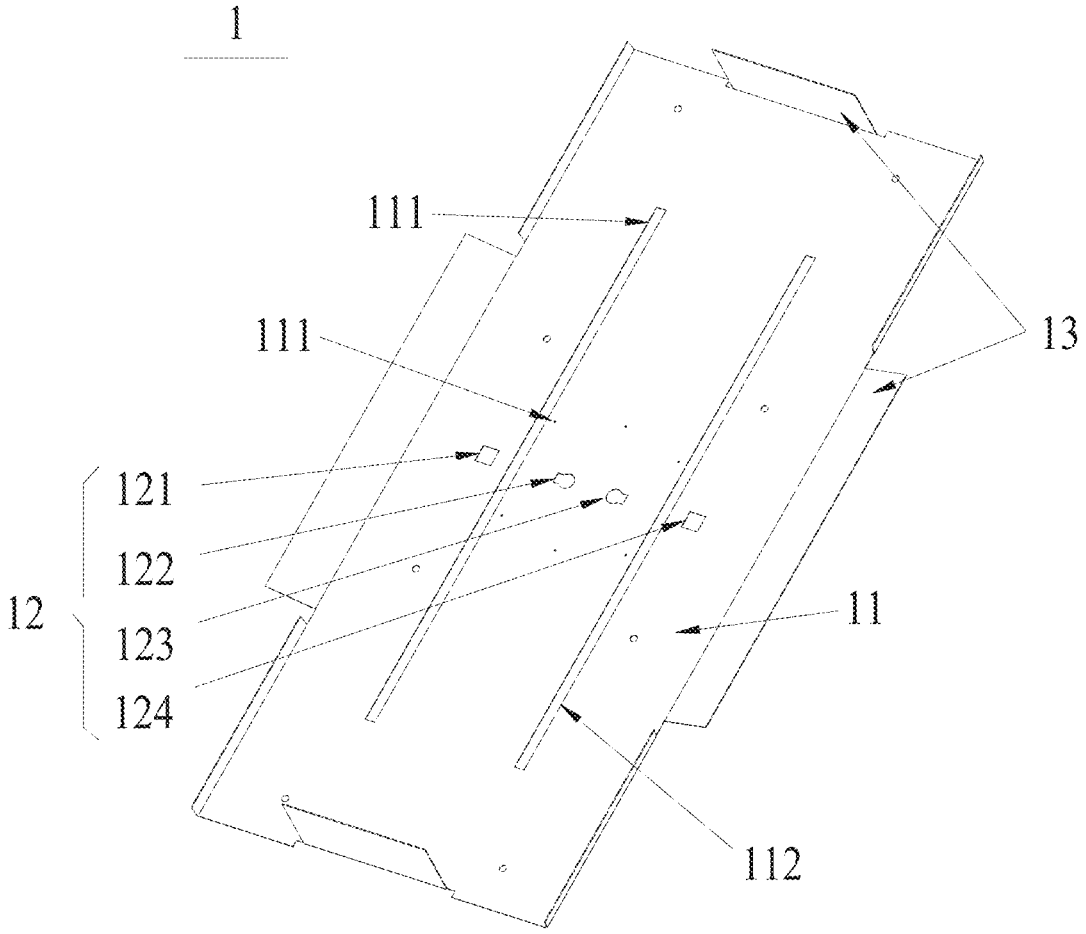
FIG. 1 shows a schematic diagram of an antenna oscillator according to an embodiment of the present disclosure.

The references in the above Figures are as follows in detail:

1—antenna oscillator; 11—antenna oscillator body; 111—the first slit; 112—the second slit; 113—the third slit; 114—the fourth slit; 115—the fifth slit; 12—the pore structure; 121—the first feed pore structure; 122—the first mounting pore structure; 123—the second mounting pore structure; 124—the second feed pore structure; 13—connecting component; 14—location hole; 2—radiation component; 20—radiation component body; 21—the first extended portion; 22—the second extended portion; the third extended portion; 24—the first through hole; 3—reflection component; 31—the second through hole.

DETAILED DESCRIPTION OF THE EMBODIMENTS

In order to make the objects, technical solutions and advantages of the present disclosure more comprehensible, the present disclosure will be further described in detail below with reference to the accompanying drawings and embodiments. It is understood that the specific embodiments described herein are merely illustrative of the disclosure and are not intended to limit the disclosure.

It should be noted that when a component is referred to as being "fixed" or "configured" to another component, it can be directly or indirectly located on the "another component". When a component is referred to as being "connected" to another component, it can be directly or indirectly connected to the other component. The terms "up", "down", "left", "right", "front", "back", "vertical", "horizontal", "top", "bottom", "inside", "outside", etc. indicate that the orientation or position is based on the orientation or position shown in the drawings and is merely for convenience of description but not to be construed as limitation to technical solutions. The terms "first" and "second" are used for convenience of description only, and are not to be understood as indicating or implying a relative importance or implicitly indicating the number of technical features. "A plurality of" means two or more, unless specifically defined otherwise.

In order to explain the technical solutions of the present disclosure, the following detailed description will be made in connection with the specific drawings and embodiments.

As shown in FIG. 1, an embodiment of the present disclosure provides an antenna oscillator 1 which includes an antenna oscillator body 11, the antenna oscillator body 11 has a planar sheet structure in a form of a rectangle and is configured with a first slit 111 and a second slit 112. The first slit 111 and a second slit 112 have a long strip-like structure without a branch. The first slit 111 and the second slit 112 extend in the longitudinal direction of the rectangle and the antenna oscillator body 11 is configured with the pore structure 12.

The antenna oscillator 1 according to an embodiment of the present disclosure transmits signals in the form of coupled radiation based on the signal principle of the slit antenna and the symmetric oscillator. The antenna oscillator body 11 is configured with the parallel first slit 111 and second slit 112 having the same strip-like structure without a branch. Compared with the conventional slit antenna, it can adjust the more parameters of the antenna, so that it can receive and transmit electromagnetic wave signals of a larger bandwidth, expand the effective bandwidth of the antenna oscillator 1, obtain better signal intensity for each frequency within the effective bandwidth, thereby receiving and transmitting signals at various frequencies within the effective bandwidth more stably. In addition, due to the expansion of the effective bandwidth, the antenna oscillator 1 provided in this embodiment can effectively reduce the time cost brought by matching, installation and test for impedance of the matching circuit in the production process and reduce the cost of materials such as the inductor and capacitor PCB board, and even there is no requirement for an external matching circuit, thereby the steps of production in a line production can be directly reduced and the cost of the antenna product can be greatly reduced.

As shown in FIG. 1, as a preferred embodiment of the present embodiment, the first slit 111 and the second slit 112 are configured in parallel and the pore structures are configured on both sides of the middle position of the first slit 121 and the second slit 122 along the longitudinal direction thereof. Specifically, the first slit 111 is configured with a first feed pore structure 121 and a first mounting pore structure 122 on both sides of the middle position along the longitudinal direction thereof and the second slit 112 is configured with the second mounting pore structure 123 and the second feed pore structure 124 on both sides of the middle position along the length direction thereof. The shapes of the first feed pore structure 121 and the second feed pore structure 124 are identical and symmetrical about the perpendicular bisector of the first slit 111 and the second slit 112. The antenna oscillator body 11 is configured with the first feed pore structure 121 and the second feed pore structure 124 so that the antenna oscillator 1, the radiation component 2 and the reflection component 3 can be firstly assembled in the installation process of the antenna. The first extension 21 of the radiation component 2 is further fed to the first feed pore structure 121 or the second feed pore structure 124. Specifically, the radiation component 2 is within internal spaces of the antenna oscillator 1 and the reflection component 3 after installation. The welding structure could be protruded into the internal space through the first feed pore structure 121 or the second feed pore structure 124 and the positive feed point of the feed line is welded to the first extended portion 21, the negative feed point of the other end of the feed line is welded to the corresponding feed pore structure nearby, thereby facilitating the connection of the feed line; the first mounting pore structure 122 and the second mounting pore structure 123 have the same shape, and are symmetrical about the perpendicular bisector of the first slit 111 and the second slit 112, and correspond to a position of the first through hole 24 of the radiation component 2 for mounting the antenna oscillator 1 and the radiation component 2 on a support such as a housing, a base body or a holder. The first mounting pore structure 122 and the second mounting pore structure 123 is symmetrical about the perpendicular bisector of the first slit 111 and the second slit 112 so that it is not necessary to distinguish the left and right direction of the antenna oscillator body 11 during processing and installation process thus the efficiency of processing and installation of the antenna oscillator 1 is improved.

Specifically, the perpendicular bisector of the first slit 111 and the second slit 112 refers to a straight line parallel to the first slit 111 and the second slit 112 and equidistant from each other on the plane where the antenna oscillator body 11 is located. Such an overall symmetrical arrangement can make the antenna oscillator 1 more beautiful in appearance and can ensure the antenna oscillator 1 has sufficient structural strength. And the symmetrically arranged structure also facilitates the processing and manufacturing of the antenna oscillator 1, as it is not necessary to distinguish the up and down direction of the antenna oscillator body 11 during assembly thus simplifying the assembly work of the antenna device. More preferably, the antenna oscillator body 11 can also be configured with a plurality of location holes 14 for connecting the antenna oscillator 1 and other components of the antenna. For example, a plurality of location holes 14 can be formed around the first mounting pore structure 122 and the second mounting pore structure 123 and used to determine the mounting position of the radiation component 2.

Figure 4:
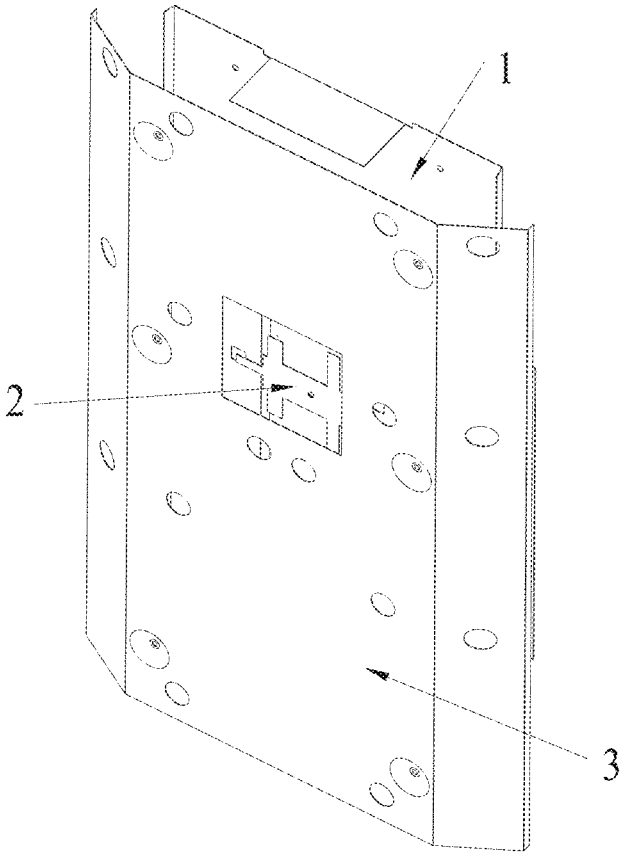
FIG. 4 shows a schematic diagram of an antenna according to one embodiment of the present disclosure.
Figure 7:
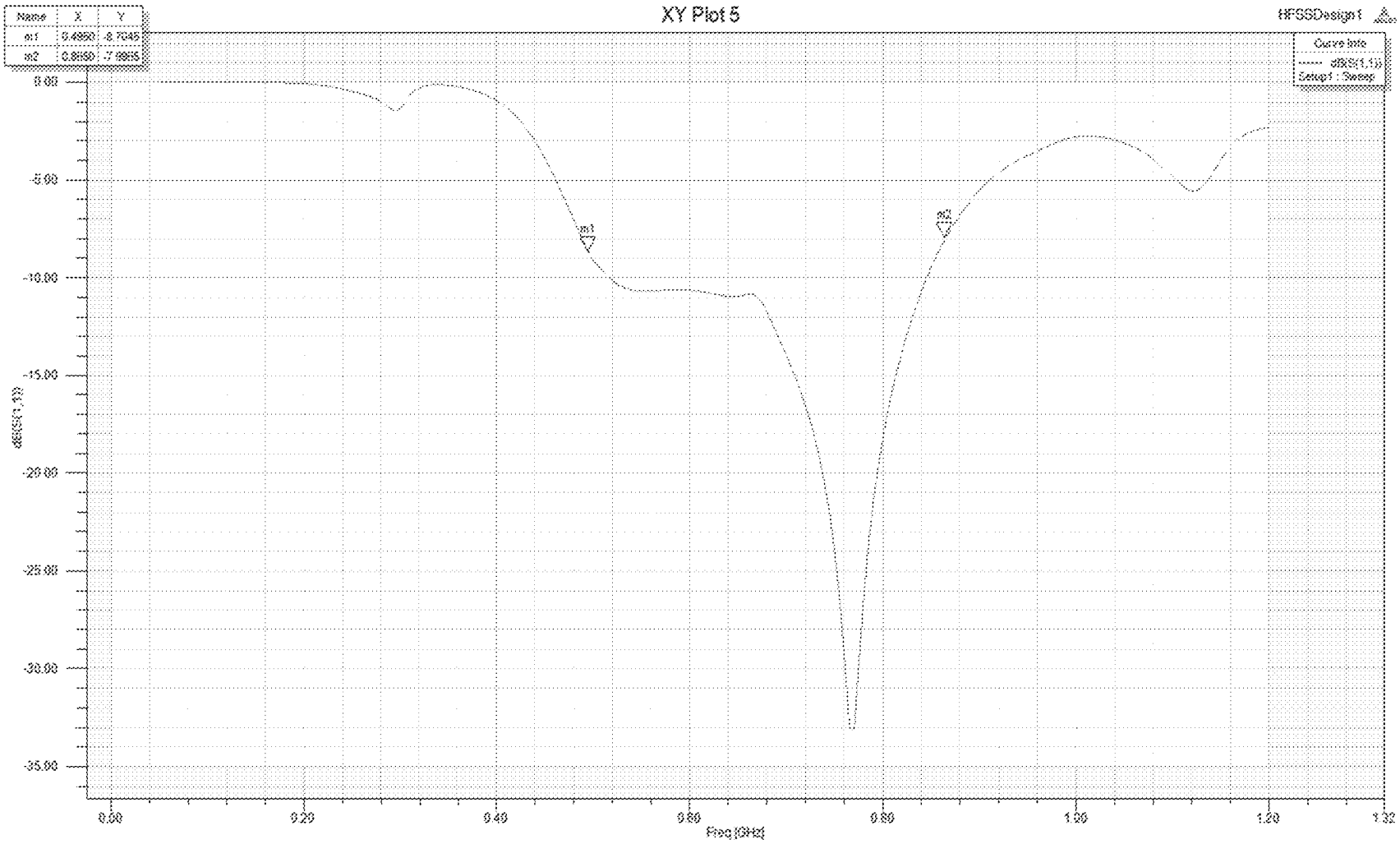
FIG. 7 shows a simulation result of signal intensity of each frequency band of an antenna according to an embodiment of the present disclosure.
Figure 8:
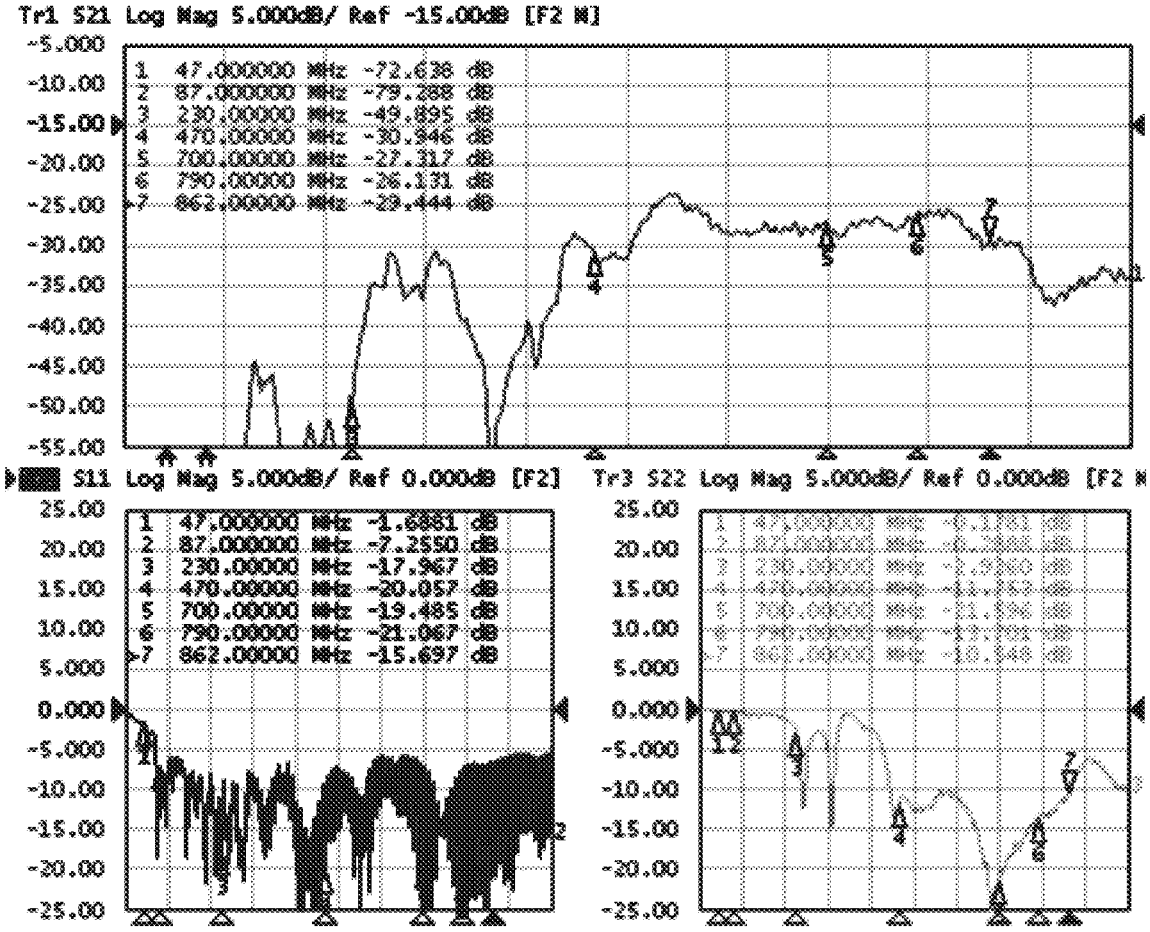
FIG. 8 shows an experimental result of signal intensity of each frequency band of an antenna according to an embodiment of the present disclosure.
Figure 9:
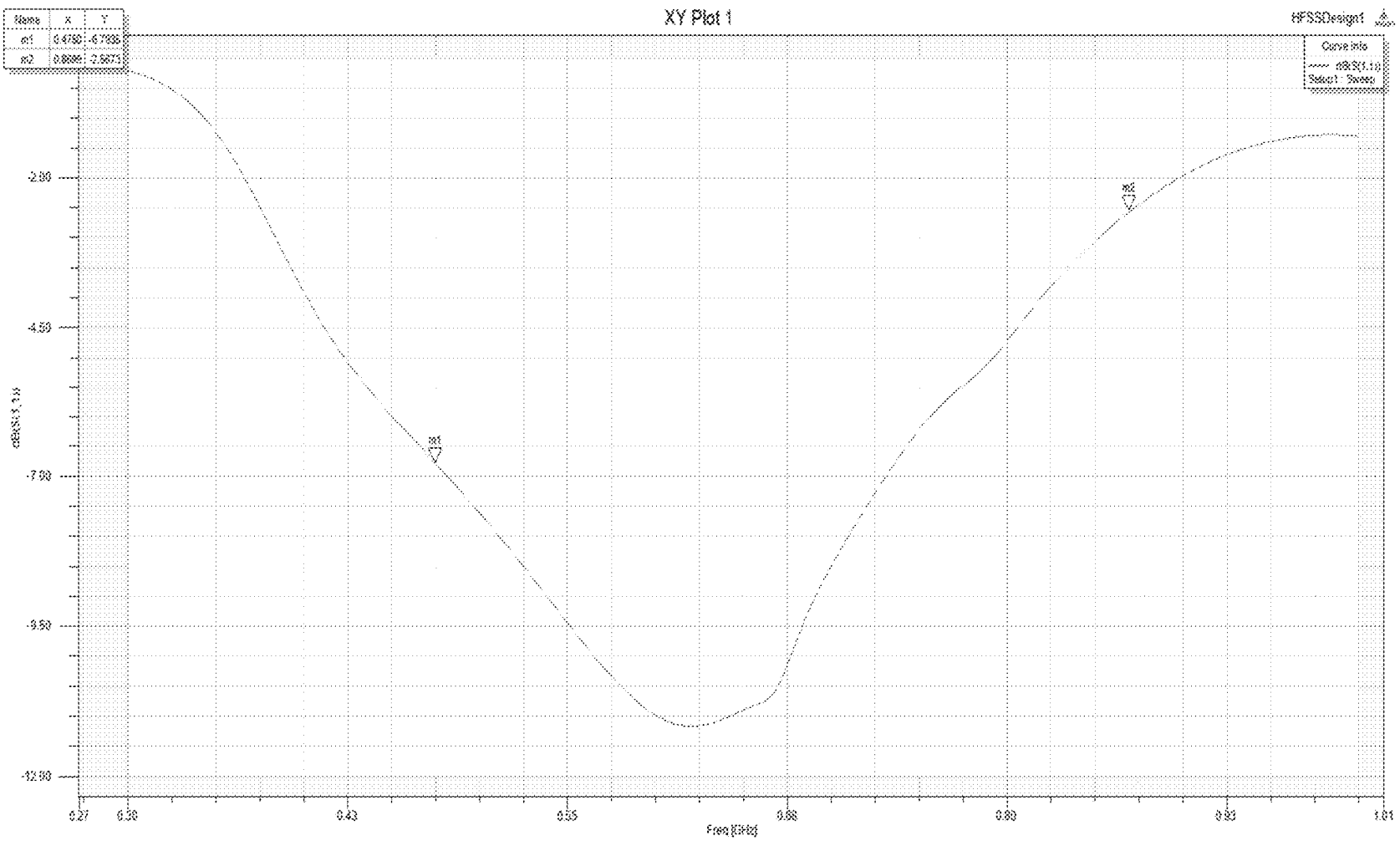
FIG. 9 shows a simulation result of signal intensity of each frequency band of a single-slit antenna under the same conditions as FIG. 7.

Referring to FIG. 7 to FIG. 9, as a specific protocol of the embodiment, the first slit 111 and the second slit 112 both have a width of 6 mm and a length of 334 mm, and the first slit 111 and the second slit 112 are spaced apart by 90 mm. Such arranged coupling antenna with double slits can obtain a wide range of effective bandwidth after adding the radiation component 2 (as shown in FIG. 4). The simulation result as shown in FIG. 7 and the actual test result as shown in FIG. 8 indicate that, the antenna oscillator body 11 configured with radiation component 2 and the reflection component 3 is capable of obtaining a signal intensity of −35 dB or above within a frequency band of 430 MHz to 900 MHz in the test.

As shown in FIG. 1, in one embodiment of the present disclosure, the first slit 111 and the second slit 112 are equal in width, parallel to each other, equal in length and are located at a middle position of the rectangle. The pore structures 12 are configured on both sides of the middle position of the first slit 111 and the second slit 112 in the longitudinal direction, the first slit 111 and the second slit 112 are symmetrical about the perpendicular bisector of the short side and/or long side of the rectangular. As such, the antenna oscillator body 11, the first slit 111 and the second slit 112 of the oscillator body 11 form a symmetrical structure, which can make the shape of the antenna oscillator 1 more beautiful and convenient for processing and manufacturing thereof so that it reduces the cost of manufacturing and processing as it is not necessary to distinguish the left and right direction of the antenna oscillator body 11 in the assembly process and it reduces the strength of the assembly work. As a preferred protocol of the present embodiment, the first slit 111 and the second slit 112 are also symmetrical about the perpendicular bisector of the long side of the rectangle, so that it is not necessary to distinguish the up and down direction of the antenna oscillator body 11 during assembly.

Figure 10:
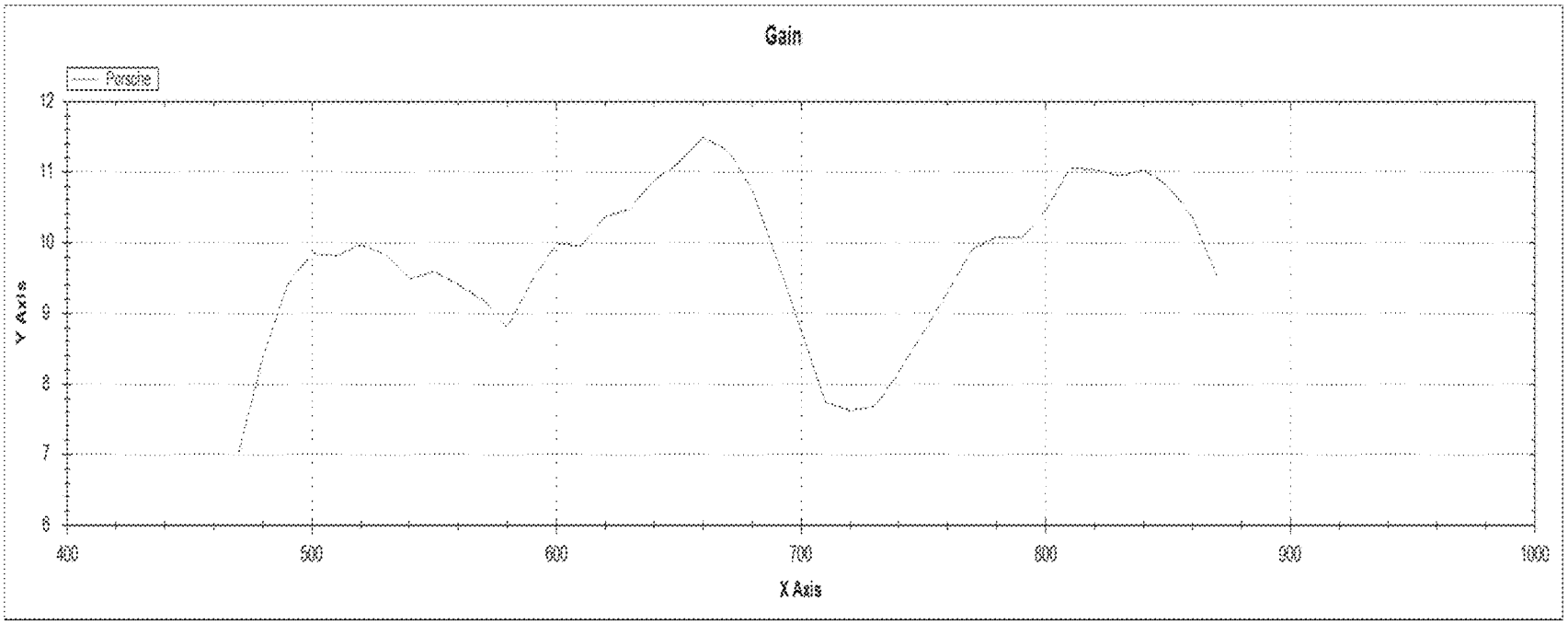
FIG. 10 shows a simulation result of signal gain of each frequency band of an antenna according to an embodiment of the present disclosure compared with an ideal standard antenna.

As shown in FIG. 1, in an embodiment of the present disclosure, the antenna oscillator 1 further includes a connecting component 13 connected to an edge position of the sheet structure of the antenna oscillator body 11, and there is an angle between the connecting component and the plane where the antenna oscillator 1 is located. The arrangement of the angle facilitates the connection of the other structures to the antenna oscillator body 11 by clamping or snapping, etc., so that the antenna oscillator body 11 can be mounted on the support structure through the connecting component 13 or connected with other antenna components. In addition to the structural function, as shown in FIG. 10, the connecting component 13 can also reduce energy and radiation loss of the antenna oscillator 1 in a side direction, thereby increasing the gain in the maximum radiation direction.

As shown in FIG. 1, as a preferred solution of the present embodiment, the antenna oscillator body 11 has a rectangular plate-like structure and the connecting component 13 is symmetrical about the perpendicular bisector of the short side and long side of the rectangle. In the process, it is not necessary to distinguish the up and down direction of the antenna oscillator body 11, which simplifies the assembly of the antenna device and improves the assembly efficiency.

In an embodiment of the present disclosure, the antenna oscillator body 11 and the connecting component 13 are each made of metal materials and the antenna oscillator body 11 and the connecting component 13 are integrally formed. The metal material can respond well to the electromagnetic wave signal and ensure that the antenna oscillator body 11 has strong receiving and transmitting capability for the electromagnetic wave signal in the effective bandwidth. In addition, the entire plate-like antenna oscillator body 11 is integrally formed of metal materials, thereby improving the structural strength of the antenna oscillator 1. For example, the antenna oscillator body 11 can maintain its own intrinsic shape in an application scenario such as an outdoor erection in a remote area and is not easily deformed by an external force, thereby avoiding changes in antenna performance and impact on its normal use caused by antenna deformation.

Figure 2:
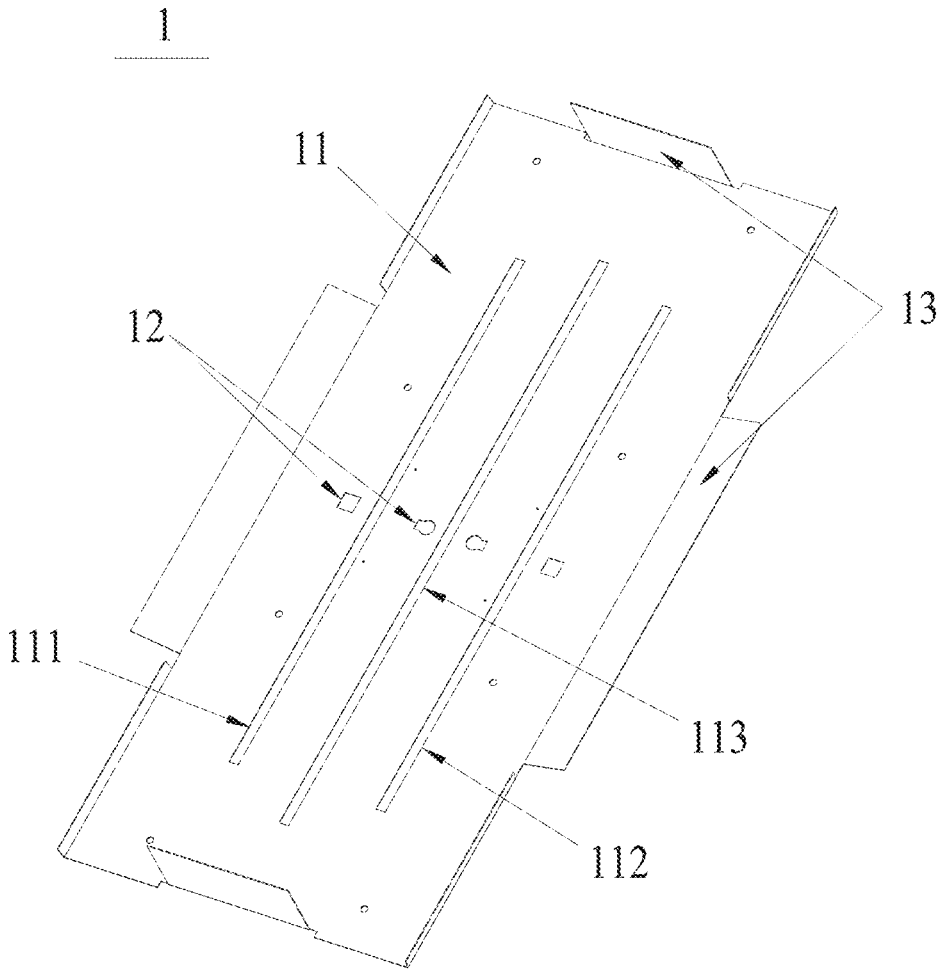
FIG. 2 shows a schematic diagram of an antenna oscillator according to another embodiment of the present disclosure.

As shown in FIG. 2, in an embodiment of the present disclosure, the antenna oscillator body 11 is further configured with a third slit 113. The third slit 113 is configured between the first slit 111 and the second slit 112. Preferably, the first slit 111, the third slit 113 and the second slit 112 are arranged in parallel and equally spaced to achieve better antenna performance. The multi-slit coupling scheme further expands the effective bandwidth of the antenna oscillator 1 and enables more stable reception and transmission of signals at various frequencies within the effective bandwidth. The antenna oscillator 1 has a wider effective bandwidth, which can effectively reduce or even eliminate the time cost of the impedance matching installation test of the matching circuit and the material cost of the electronic component.

As a preferred embodiment of the present disclosure, the third slit 113 has a length slightly longer than the first slit 111 and the second slit 112. The first slit 111, the second slit 112 and the third slit 113 form a shape, which is symmetrical about the perpendicular bisector of the short side and the long side of rectangular so that the structure of the antenna oscillator 1 is more beautiful and the manufacturing cost thereof can be reduced as it is not necessary to distinguish the up and down direction of the antenna oscillator body 11 in the assembly process, which simplifies the assembly work of the antenna device.

Figure 3:
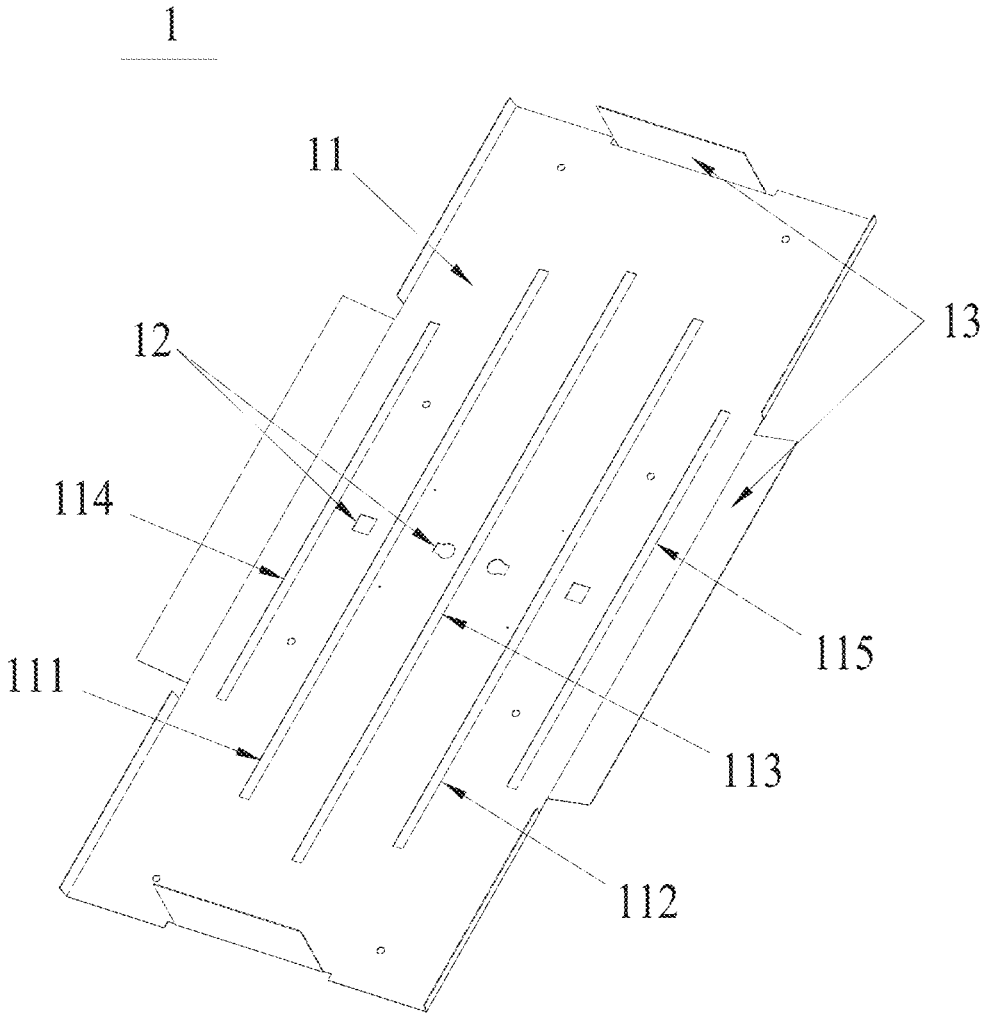
FIG. 3 shows a schematic diagram of an antenna oscillator according to another embodiment of the present disclosure.

As shown in FIG. 3, in an embodiment of the present disclosure, the antenna oscillator body 11 is further configured with a fourth slit 114 and a fifth slot 115. The lengths of the fourth slit 114 and the fifth slit 115 are smaller than the length of the first slit 111. The fourth slit 114 and the fifth slit 115 are configured on one side of the first slit 111 and the second slit 112 opposite to the third slit 113. Preferably, the fourth slit 114, the first slit 111, the third slit 113, the second slit 112 and the fifth slit 115 are arranged parallel to each other and equally spaced to achieve better antenna performance. The multi-slit coupling scheme further expands the effective bandwidth of the antenna oscillator 1 and can obtain better signal intensity for each frequency in the effective bandwidth. Therefore, it is more stable to receive and transmit signals of various frequencies within the effective bandwidth. Since the antenna oscillator 1 can cover a wider signal frequency range, in the production process, the time cost brought by the impedance matching installation test of the matching circuit and the cost of materials such as an inductor, a capacitor and a PCB board can be effectively reduced or even avoided.

As a preferred scheme of the present embodiment, the length of the third slit 113 is slightly longer than the length of the first slit 111, the fourth slit 114 and the fifth slit 115 but is slightly shorter than the length of the first slit 111. The shape formed by the first slit 111, the second slit 112, the third slit 113, the fourth slit 114 and the fifth slit 115 is symmetrical about the perpendicular bisector of short side and long side of the rectangular, so that the structure of the antenna oscillator 1 is more beautiful and the manufacturing cost can be reduced. It is not necessary to distinguish the up and down direction of the antenna oscillator body 11 during the assembly process, which simplifies the assembly of the antenna device.

Figure 5:
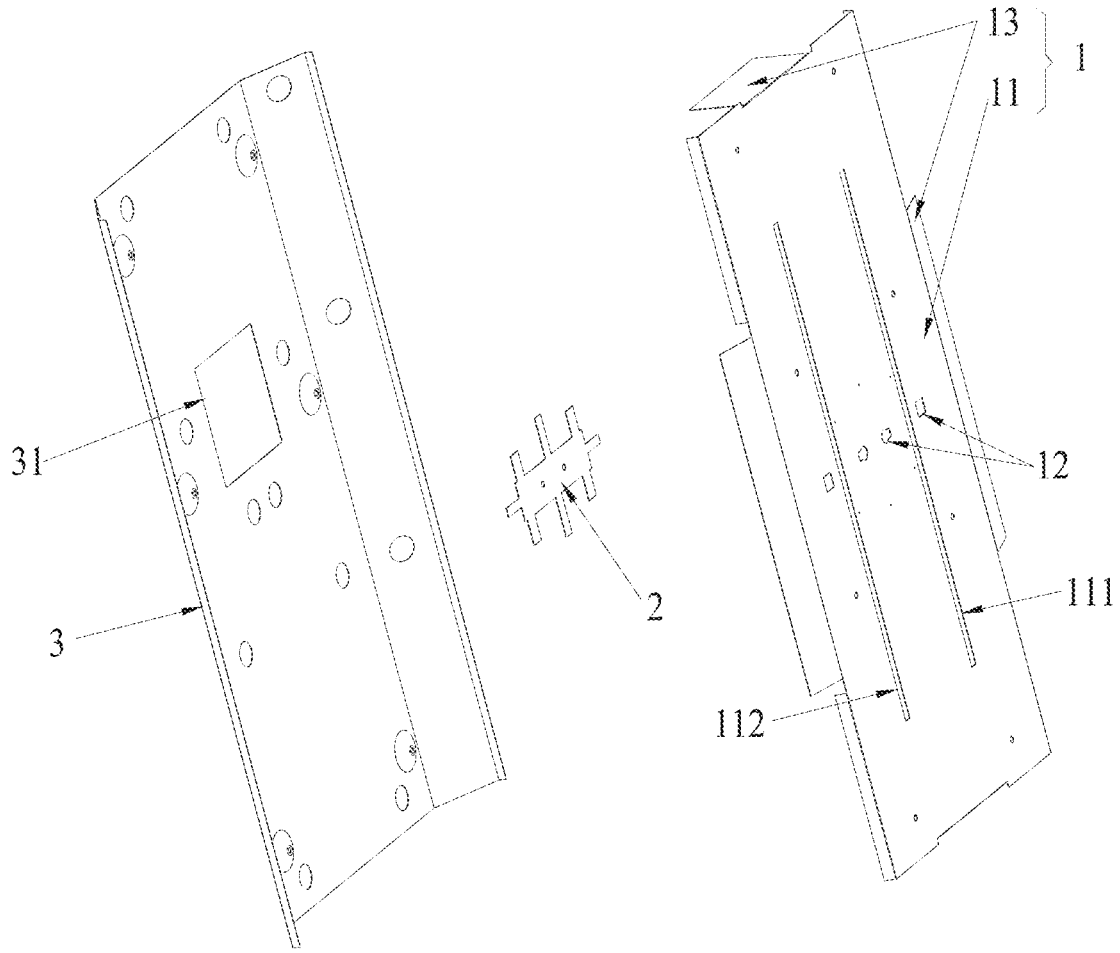
FIG. 5 shows an explosion diagram of an antenna according to an embodiment of the present disclosure.

As shown in FIGS. 4 and 5, another purpose of the embodiments of the present disclosure is to provide an antenna including the antenna oscillator 1 according to any of the above embodiments, the antenna further includes a radiation component 2 and a reflection component 3. The radiation component 2 is configured at a position corresponding to an middle position of the first slit 111 and the second slit 112 in the longitudinal direction and is fed to the antenna oscillator 1; the reflection component 3 is configured on one side of the radiation component 2 opposite to the antenna oscillator 1 and insulated from the antenna oscillator 1. The radiation component 2 is used for debugging the effective radiation bandwidth of the antenna oscillator 1 and the reflection component 3 is used for improving the gain performance and the directional performance of the signal transmitted and received by the antenna oscillator 1.

Figure 6:
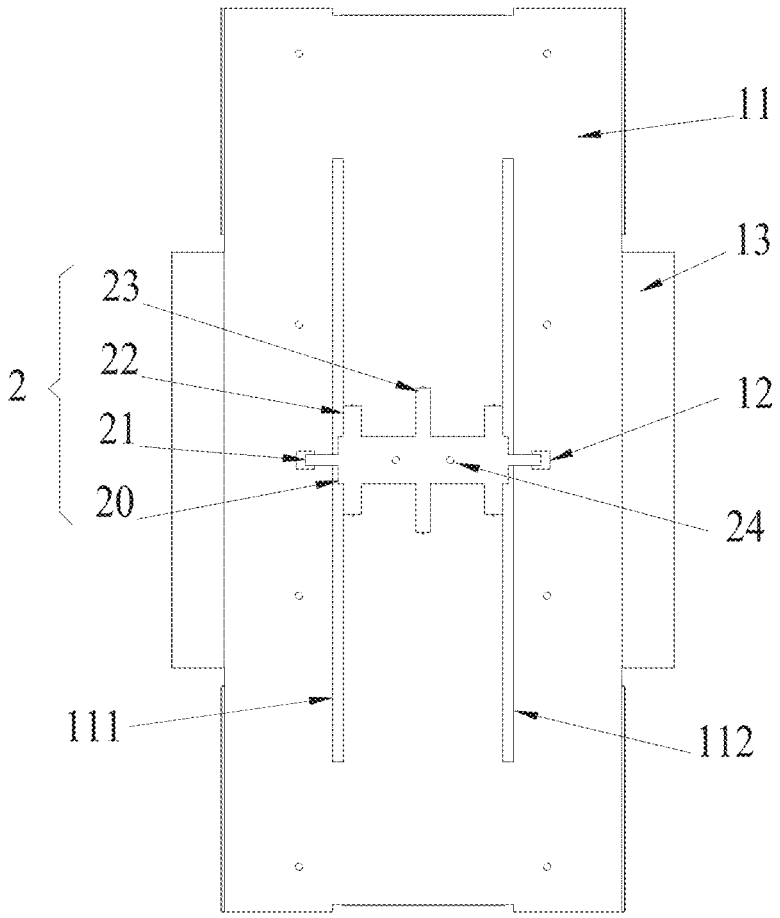
FIG. 6 shows a schematic diagram of connection between an antenna oscillator and a radiation component according to an embodiment of the present disclosure.

As shown in FIG. 6, in one embodiment of the present disclosure, the radiation component 2 is configured with the first through hole 24 opposite to the position of the pore structure 12 and the first through hole 24 is used for mounting and fixing the radiation component 2. The radiation component 2 and the antenna oscillator 1 are connected by a feed line to form a symmetric oscillator and the coupled resonant component can effectively cover the frequency band of 430 Mhz-900 Mhz without additional circuit or magnetic core, capacitor or inductor components for impedance matching. Thereby, the hardware cost of the antenna is reduced, the impedance matching step of the matching circuit is also avoided and the design and manufacturing cost of the antenna are reduced.

As shown in FIG. 6, in one embodiment of the present disclosure, the radiation component 2 is configured on one side of the antenna oscillator 11 and corresponds to a portion between the first slit 111 and the second slit 112, including the first extended portion 21 and the second extended portion 22. The first extended portion 21 is used for feeding with the antenna oscillator body 11 and the edge of the second extended portion 22 is aligned with the inner edge of the first slit 111 and the second slit 112. Specifically, the first extended portion 21 connects through all the pore structures 12 to facilitate the feeding. In a specific scheme of the embodiment, the positive feed point is at the end of the first extended portion 21 away from the radiator body and the negative feed point is at the antenna oscillator 1, therefore, such an arrangement facilitates the connection of the feed line after installation of the radiation component 2 and the reflection component 3 and the welding device can traverse the first feed pore structure 121 or the second feed pore structure 124. Weld the first extended portion 21, such as a feed line, to achieve welding of the positive feed point and then weld the other end of the feed line to the antenna oscillator body 11. Preferably, in the first feed pore structure 121 or the second feed pore structure 124, the pore structure 12 closer to the positive feed point serves as a negative feed point and the other end of the feed structure is welded thereto. The arrangement of the first feed pore structure 121 and the second feed pore structure 124 facilitates the connection of the positive and negative feed points, simplifying the routing inside the antenna.

As a specific scheme of the embodiment, the radiation component 2 includes a radiation component body 20, a first extended portion 21, a second extended portion 22 and a third extended portion 23. The radiation component body 20 is a metal plate with a rectangular shape which is configured with the first through hole 24. The first extended portion 21 is configured at a central portion of the wide side thereof the radiation component body 20 and extends outwardly; the second extended portion 22 is configured at both ends of the long side of the radiation component body 20 and extends outward in a direction of the wide side thereof; the third extended portion 23 is configured at a middle position of the long side of the radiation component body 20 and extends outward. After being assembled in combination with the antenna oscillator 1, the first extended portion 21 is used for feeding with the antenna oscillator body 11, the edge of the second extended portion 22 is aligned with an inner edge of the first slit 111 and the second slit 112. For the arrangement in which the third slit 113 is provided, the third extended portion 23 corresponds to the position of the third slit 113 and covers a portion of the middle part of the third slit 113.

As shown in FIG. 4 and FIG. 5, in one embodiment of the present disclosure, the reflection component 3 is configured with the second through hole 31. The second through hole for arranging the PCB expansion plate to improve the expandability of the reflection component 3. The performance of the antenna can be improved by installing a functional device such as an amplifier or a filter at the second through hole 31. Preferably, the size of the second through hole 31 is determined according to the size of the PCB expansion board to be installed and the opening of the second through pore structure should not be too large to affect the structural strength of the reflection component 3.

As a specific scheme of the present embodiment, the edge of the reflection component 3 is bent in the direction facing the radiation component 2 and the antenna oscillator 1, so that the directional performance of the reflection component 3 and the gaining ability of the signal intensity can be further optimized.

The above description only describes alternative embodiments of the present disclosure, and is not intended to limit the present disclosure. Any modifications, equivalent replacements and improvements made within the spirit and principles of the present disclosure should be included in the scope of protection of the present disclosure.

What is claimed is:

1. An antenna oscillator, comprising an antenna oscillator body, wherein the antenna oscillator body has a planar sheet structure in a form of a rectangle and is provided with a first slit and a second slit; the first slit and the second slit have a long strip-shaped structure without a branch, and the first slit and the second slit extend in a direction of a long side of the rectangle; and the antenna oscillator body is provided with a pore structure thereon; wherein the antenna oscillator further comprises a connecting component, the connecting component is connected to an edge position of the antenna oscillator body, and there is an angle between the connecting component and a plane at which the antenna oscillator is located; wherein the antenna oscillator body and the connecting component are made of one piece by a metal material.

2. The antenna oscillator according to claim 1, wherein the first slit and the second slit are equal in width, parallel to each other, and equal in length, and are located at a middle position of the rectangle; the pore structures are configured at two sides of the middle position in a longitudinal direction of the first slit and two sides of the middle position in a longitudinal direction of the second slit; the first slit and the second slit are symmetrical about a perpendicular bisector of a short side of the rectangle and/or the long side of the rectangle.

3. The antenna oscillator according to claim 1, wherein the antenna oscillator body is further provided with a third slit, and the third slit is arranged between the first slit and the second slit.

4. The antenna oscillator according to claim 3, wherein the antenna oscillator body is further provided with a fourth slit and a fifth slit, and the fourth slit and the fifth slit have a length smaller than the first slit and are arranged at a side of the first slit facing away from the third slit and a side of the second slit facing away from the third slit, respectively.

5. An antenna, comprising an antenna oscillator comprising an antenna oscillator body, wherein the antenna oscillator body has a planar sheet structure in a form of a rectangle and is provided with a first slit and a second slit the first slit and the second slit have a long strip-shaped structure without a branch, and the first slit and the second slit extend in a direction of a long side of the rectangle; and the antenna oscillator body is provided with a pore structure thereon; wherein the antenna further comprises a radiation component and a reflection component, the radiation component is arranged at a side of the antenna oscillator and is configured for feed connection with the antenna oscillator, a position of the radiation component corresponds to a middle position of the first slit and the second slit in a longitudinal direction, and the reflection component is arranged at a side of the radiation component facing away from the antenna oscillator and is insulated from the antenna oscillator.

6. The antenna according to claim 5, wherein the radiation component is provided with a first through hole opposite to a position of the pore structure, and the first through hole is configured to mount and fix the radiation component.

7. The antenna according to claim 6, wherein the radiation component is arranged at a side of the antenna oscillator and at a position corresponding to a portion between the first slit and the second slit, the radiation component comprises a first extended portion and a second extended portion, the first extended portion is configured for feed connection with the antenna oscillator body, and an edge of the second extended portion is aligned with inner edges of the first slit and the second slit.

8. The antenna according to claim 5, wherein the reflection component is configured with a second through hole for arranging a PCB expansion board.

9. The antenna oscillator according to claim 2, wherein the antenna oscillator body is further provided with a third slit, and the third slit is arranged between the first slit and the second slit.

10. The antenna according to claim 5, wherein the first slit and the second slit are equal in width, parallel to each other, and equal in length, and are located at a middle position of the rectangle; the pore structures are configured at two sides of the middle position in a longitudinal direction of the first slit and two sides of the middle position in a longitudinal direction of the second slit; the first slit and the second slit are symmetrical about a perpendicular bisector of a short side of the rectangle and/or the long side of the rectangle.

11. The antenna according to claim 5, wherein the antenna oscillator further comprises a connecting component, the connecting component is connected to an edge position of the antenna oscillator body, and there is an angle between the connecting component and a plane at which the antenna oscillator is located.

12. The antenna according to claim 11, wherein the antenna oscillator body and the connecting component are made of one piece by a metal material.

13. The antenna according to claim 5, wherein the antenna oscillator body is further provided with a third slit, and the third slit is arranged between the first slit and the second slit.

* * * * *